US006005524A

United States Patent [19]

Hayes et al.

[11] Patent Number: 6,005,524

[45] Date of Patent: Dec. 21, 1999

[54] FLEXIBLE DIVERSITY ANTENNA

[75] Inventors: Gerard James Hayes, Wake Forest; James D. MacDonald, Jr., Apex; John Michael Spall, Raleigh, all of N.C.

[73] Assignee: Ericsson Inc., Research Triangle Park, N.C.

[21] Appl. No.: 09/031,223

[22] Filed: Feb. 26, 1998

[51] Int. Cl.[6] ..... H01Q 1/24

[52] U.S. Cl. ..... 343/702; 343/895; 343/873

[58] Field of Search ..... 343/702, 700 MS, 343/872, 873, 895, 841, 709

[56] References Cited

U.S. PATENT DOCUMENTS 5,365,246 11/1994 Rasinger et al. ..... 343/702

FOREIGN PATENT DOCUMENTS

WO 93/12559 6/1993 WIPO .
WO 96/27219 9/1996 WIPO .

OTHER PUBLICATIONS

PCT International Search Report, PCT International Application No. PCT/US99/03949, (Nov. 5,1999).

*Primary Examiner*—Don Wong
*Assistant Examiner*—Hoang Nguyen
*Attorney, Agent, or Firm*—Myers Bigel Sibley & Sajovec, P.A.

[57] ABSTRACT

Flexible diversity antennas having gain and bandwidth capabilities suitable for use within small communications devices such as radiotelephones are provided. A core of flexible material has an electrical conductor embedded therewithin in a meandering pattern and is surrounded by a first layer of flexible dielectric material. At one end of the antenna, the first layer of dielectric material is surrounded by flexible conductive material. The flexible conductive material is surrounded by a second layer of flexible dielectric material. The portion of the antenna surrounded by conductive material serves as a tuning element, and the portion of the antenna not surrounded by conductive material serves as a radiating element. A flexible signal feed is integral with the antenna and extends outwardly from the flexible core.

37 Claims, 4 Drawing Sheets

Fig. 7A
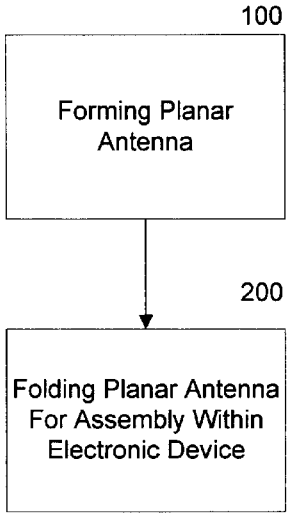
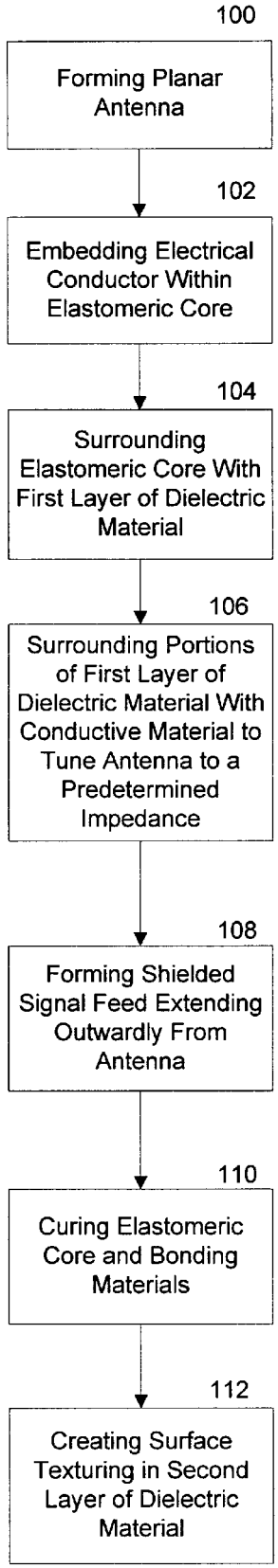
Fig. 7B

FLEXIBLE DIVERSITY ANTENNA

FIELD OF THE INVENTION

The present invention relates generally to antennas, and more particularly to antennas used within communication devices.

BACKGROUND OF THE INVENTION

Antennas for personal communication devices, such as radiotelephones, may not function adequately when in close proximity to a user during operation, or when a user is moving during operation of a device. Close proximity to objects or movement of a user during operation of a radiotelephone may result in degraded signal quality or fluctuations in signal strength, known as multipath fading. Diversity antennas have been designed to work in conjunction with a radiotelephone's primary antenna to improve signal reception.

Many of the popular hand-held radiotelephones are undergoing miniaturization. Indeed, many of the contemporary models are only 11–12 centimeters in length. Unfortunately, as radiotelephones decrease in size, the amount of internal space therewithin may be reduced correspondingly. A reduced amount of internal space may make it difficult for existing types of diversity antennas to achieve the bandwidth and gain requirements necessary for radiotelephone operation because their size may be correspondingly reduced.

One type of diversity antenna is referred to as a Planar Inverted F Antenna (PIFA). A PIFA derives its name from its resemblance to the letter "F" and typically includes various layers of rigid materials formed together to provide a radiating element having a conductive path therein. The various layers and components of a PIFA are typically mounted directly on a molded plastic or sheet metal support structure. Because of their rigidity, PIFAs are somewhat difficult to bend and form into a final shape for placement within the small confines of radiotelephones. In addition, PIFAs may be susceptible to damage when devices within which they are installed are subjected to impact forces. Impact forces may cause the various layers of a PIFA to crack, which may hinder operation or even cause failure.

Various stamping, bending and etching steps may be required to manufacture a PIFA because of their generally non-planar configuration. Consequently, manufacturing and assembly is typically performed in a batch-type process which may be somewhat expensive. In addition, PIFAs typically utilize a shielded signal feed, such as a coaxial cable, to connect the PIFA with the RF circuitry within a radiotelephone. During assembly of a radiotelephone, the shielded signal feed between the RF circuitry and the PIFA typically involves manual installation, which may increase the cost of radiotelephone manufacturing.

SUMMARY OF THE INVENTION

It is, therefore, an object of the present invention to provide PIFAs that can easily conform within the internal confines of small communications devices such as radiotelephones.

It is another object of the present invention to provide small PIFAs that can have sufficient gain and bandwidth capabilities for use within radiotelephones.

It is also an object of the present invention to provide PIFAs that can be less vulnerable to damage caused by impact forces to the devices within which they are installed.

It yet another object of the present invention to simplify radiotelephone assembly and thereby reduce radiotelephone manufacturing costs.

These and other objects of the present invention are provided by flexible diversity antennas that can have gain and bandwidth capabilities suitable for use within small communications devices such as radiotelephones. A core of flexible material, such as silicone, has an electrical conductor embedded therewithin and is surrounded by a first layer of flexible dielectric material. At one end of the antenna, the first layer of dielectric material is surrounded by conductive material, such as copper or nickel fabric. The conductive material is flexible and replaces rigid metallic elements typically utilized in PIFAs.

The conductive material is preferably surrounded by a second layer of flexible dielectric material. The portion of the antenna surrounded by conductive material serves as a tuning element, and the portion of the antenna not surrounded by conductive material serves as a radiating element. Preferably, the electrical conductor within the core extends between the radiating and tuning elements along a meandering path.

A flexible signal feed is integral with the antenna and extends outwardly from the flexible core. The signal feed is electrically connected to the electrical conductor embedded within the flexible core. The signal feed is surrounded by a layer of flexible material, preferably the same material as the flexible core. This flexible material is surrounded by a layer of dielectric material. Surrounding this layer of dielectric material is a layer of conductive material which serves to shield the signal feed. This layer of conductive material may be surrounded by another layer of dielectric material.

Operations for fabricating a flexible diversity antenna having a predetermined impedance, include: forming a planar antenna element having an electrical conductor embedded within an elastomeric core, a first layer of dielectric material surrounding the elastomeric core, portions of the first layer of dielectric material surrounded with conductive material, and a second layer of dielectric material surrounding the conductive material; and then folding the planar antenna element into a shape for assembly within an electronic device, such as a radiotelephone. The elastomeric core and material utilized to laminate the various layers of material around the core are cured prior to folding the planar antenna element into a shape for assembly within an electronic device. During curing operations, texturing of the surface of the second layer of dielectric material may be performed.

Diversity antennas according to the present invention can be manufactured in a planar configuration, which is conducive to high volume automated production. Furthermore, repeatable impedance characteristics are obtainable through the selection of materials and the control of thickness of the various layers of materials. Because flexible dielectric and conductive materials are utilized, the antennas can then be formed into various shapes so as to fit into small areas during radiotelephone assembly.

In contrast with known diversity antennas, the present invention is capable of achieving sufficient gain and bandwidth for radiotelephone operation for a given size and location. Using this invention, the antenna designer has a greater degree of design flexibility than with known diversity antennas. Furthermore, conductive material can be selectively added to create a controlled impedance stripline transmission medium on sections of the antenna.

The relatively rigid antenna assemblies in previous PIFAs generally do not lend themselves to being folded easily to conform with small spaces within communications devices. By contrast, diversity antennas according to the present invention have a flexible configuration that allows the antenna to conform to the small space constraints of current radiotelephones and other communication devices. The flexible configuration of the present invention can also reduce the possibility of damage from impact forces. Furthermore, the present invention incorporates an integral, flexible signal feed which eliminates the need for a separate coaxial cable to connect the antenna with signal circuitry within a device. Accordingly, assembly costs of communications devices, such as radiotelephones, can be reduced.

BRIEF DESCRIPTION OF THE DRAWINGS

FIGS. 7A–7B schematically illustrate operations for fabricating flexible diversity antennas according to aspects of the present.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As is known to those skilled in the art, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain. Radiation patterns for antennas are often plotted using polar coordinates. Voltage Standing Wave Ratio (VSWR) relates to the impedance match of an antenna feed point with the feed line or transmission line. To radiate RF energy with minimum loss, or to pass along received RF energy to the receiver with minimum loss, the impedance of the antenna should be matched to the impedance of the transmission line or feeder.

Radiotelephones typically employ a primary antenna which is electrically connected to a transceiver operably associated with a signal processing circuit positioned on an internally disposed printed circuit board. In order to maximize power transfer between the antenna and the transceiver, the transceiver and the antenna are preferably interconnected such that the respective impedances are substantially "matched," i.e., electrically tuned to filter out or compensate for undesired antenna impedance components to provide a 50 Ohm (or desired) impedance value at the circuit feed.

As is well known to those skilled in the art, a diversity antenna may be utilized in conjunction with a primary antenna within a radiotelephone to prevent calls from being dropped due to fluctuations in signal strength. Signal strength may vary as a result of a user moving between cells in a cellular telephone network, a user walking between buildings, interference from stationary objects, and the like. Diversity antennas are designed to pick up signals that the main antenna is unable to pick up through spatial, pattern, and bandwidth or gain diversity.

Figure 1:
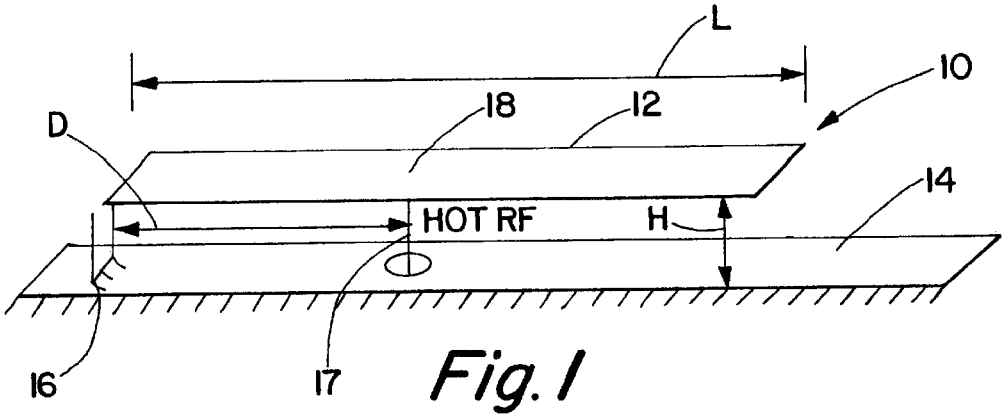
Fig. 1 (PRIOR ART)
FIG. 1 illustrates a typical PIFA used within radiotelephones.

A type of diversity antenna well known in the art is the Planar Inverted F Antenna (PIFA) and is illustrated in FIG. 1. The illustrated PIFA 10 includes a radiating element 12 maintained in spaced apart relationship with a ground plane 14. The radiating element is also grounded to the ground plane 14 as indicated by 16. A hot RF connection 17 extends from underlying circuitry through the ground plane 14 to the radiating element 12 at 18. A PIFA is tuned to desired frequencies by adjusting the following parameters which can affect gain and bandwidth: varying the length L of the radiating element 12; varying the gap H between the radiating element 12 and the ground plane 14; and varying the distance D between the ground and hot RF connections. Other parameters known to those skilled in the art may be adjusted to tune the PIFA, and will not be discussed further.

Figure 2:
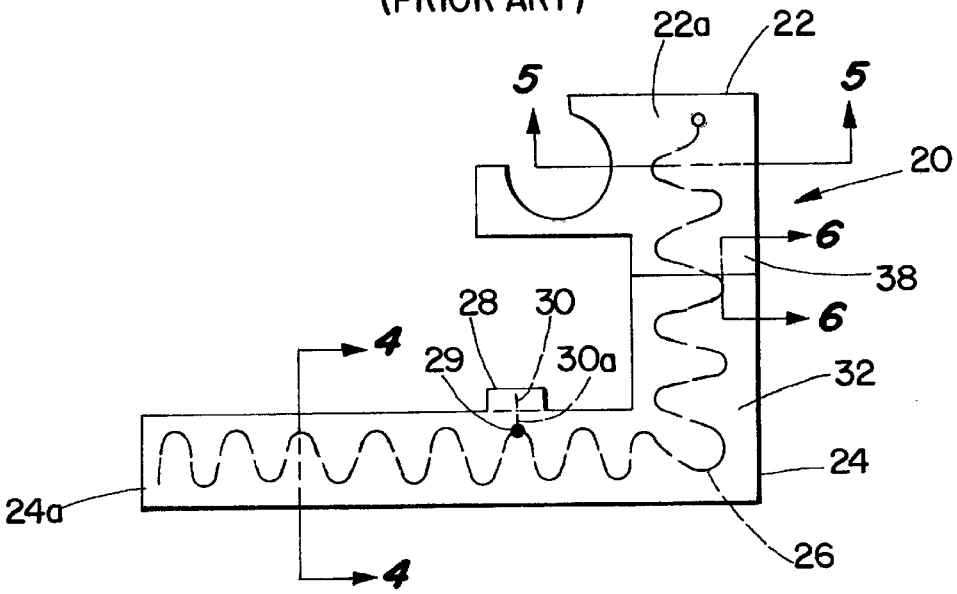
FIG. 2 is a plan view of a flexible PIFA according to aspects of the present invention.

Referring now to FIG. 2, a planar diversity antenna 20 in accordance with a preferred embodiment of the present invention is illustrated. The antenna 20 has an "F" shape and includes a tuning portion 22 and an adjacent radiating portion 24, as indicated. The antenna 20 is preferably manufactured in a planar configuration as illustrated in FIG. 2. Prior to assembly within a communications device, the flexible antenna is folded to conform with the internal space of the device.

Figure 3:
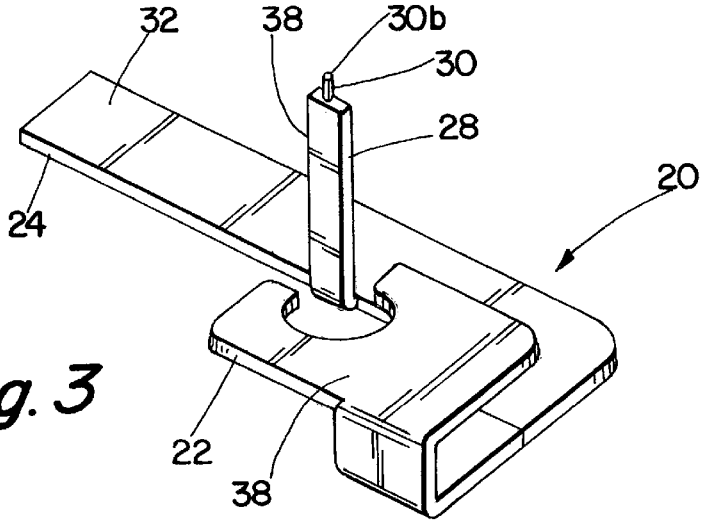
FIG. 3 is a perspective view of the PIFA illustrated in FIG. 2 with the tuning portion in a folded configuration.

FIG. 3 illustrates the antenna 20 with its tuning portion 22 folded under the radiating element 24 so that the antenna has the proper configuration for assembly within a particular communications device. FIG. 3 also illustrates the shielded flexible signal feed 28 in a substantially transverse orientation with respect to the radiating element 24 so as to be in proper orientation for connection with signal circuitry within a communications device. A flexible diversity antenna according to the present invention can be formed into various shapes as required to facilitate installation within various internal spaces of devices such as radiotelephones.

Referring back to FIG. 2, a continuous electrical conductor 26 extends between the tuning element 22 and radiating element 24 and serves as an antenna element for sending and receiving electronic signals. In the illustrated embodiment, the electrical conductor 26 extends from a tuning element end portion 22*a* to an opposite radiating element end portion 24*a* in a meandering pattern.

A flexible, shielded RF or microwave signal feed 28 is integrally connected to the radiating element 24 of the antenna 20, as illustrated. The shielded signal feed 28 has a similar construction to that of the radiating element 22, which is described in detail below. An electrical conductor 30 is contained within the flexible signal feed 28 and has opposite end portions 30*a* and 30*b*. The electrical conductor 30 is electrically connected at end portion 30*a* with the electrical conductor 26 of the radiating element 24 at location 29, as illustrated. Opposite end portion 30*b* is preferably configured for assembly to a circuit board via conventional connection techniques including soldering, displacement connectors, conductive elastomers, metal compression contacts, and the like.

The flexible signal feed 28 can be configured in various orientations to facilitate assembly within radiotelephones and other electronic devices. Conventional diversity antennas generally require a shielded signal feed from the main circuit board in a radiotelephone. Coaxial cables are often used for this purpose. However, coaxial cables are relatively costly and require manual assembly. The present invention is advantageous because a shielded signal feed 28 is provided as an integral part of the antenna 20.

Figure 4:
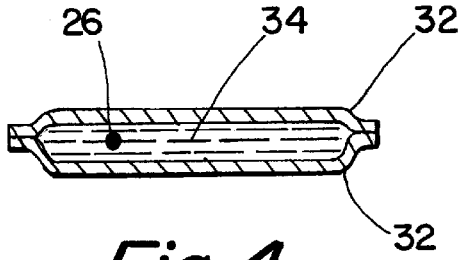
FIG. 4 is a sectional view of the PIFA illustrated in FIG. 2 taken along lines 4—4.

Referring now to FIG. 4, a cross-sectional view of the radiating element 24 of the antenna 20 of FIG. 2 taken along lines 4—4 is illustrated. The electrical conductor 26 is embedded within a flexible core 34. The flexible core is preferably formed from an elastomeric material such as silicone. Preferably, the flexible core is also formed from a dielectric material having a dielectric constant between about 1.8 and 2.2. A first layer of flexible dielectric material 32 surrounds the elastomeric core 34 as illustrated. Preferably, the first layer of dielectric material has a dielectric constant between about 1.8 and 2.2. The first layer of dielectric material may be formed from non-metalized, woven or knit fabrics. Polyester or liquid crystal polymer (LCP) cloth capable of withstanding processing temperatures up to 120° C. is an exemplary dielectric material for use as the first layer of dielectric material 32.

Figure 5:
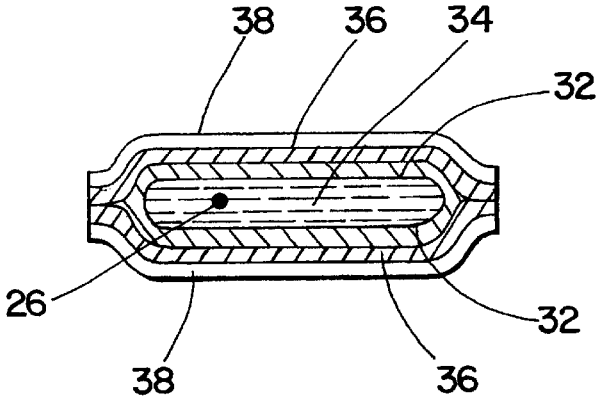
FIG. 5 is a sectional view of the PIFA illustrated in FIG. 2 taken along lines 5—5.

Referring now to FIG. 5, a cross-sectional view of the tuning element 22 of the antenna 20 of FIG. 2 taken along lines 5—5 is illustrated. A layer of flexible conductive material 36 surrounds the first layer of dielectric material 32. Preferably the conductive material 36 is metalized fabric. Preferred metalized fabrics are those with high strength and high temperature processing capability. Exemplary metalized fabrics include, but are not limited to, polyester or liquid crystal polymer (LCP) woven fabric having fibers coated with copper, followed by a nickel outer layer; nickel and copper fabrics formed of metallic fibers or metallic felt structures; carbon fiber fabrics formed of fiber or felt structures. Alternatively, portions of the first layer of dielectric material 32 may be metalized with conductive material on the outer surface.

Preferably, the metalized fabric 36 is laminated to the first layer of dielectric material 32 with an elastomeric material such as silicone. The silicone fills the voids in the metalized fabric to enhance bending characteristics. As is known to those skilled in the art, silicone provides consistent flexibility with high elongation over various temperatures, particularly low temperatures. The conductive material 36 may then be surrounded as illustrated with a second layer of flexible dielectric material 38. The second layer of dielectric material 38 may be formed from non-metalized polymers formed as films, or as woven or knit fabrics. Polyetherimide (PEI) films, or cloth made of polyester or liquid crystal polymer (LCP) capable of withstanding processing temperatures up to 120° C. is an exemplary dielectric material for use as the second layer of dielectric material 38.

The thickness of the first and second layers of dielectric material 32, 38 can be varied during manufacturing of the antenna 20 to produce a controlled characteristic impedance for the electrical conductor. The characteristic impedance ($Z_0$) of the RF transmission line is calculated from the geometry and the dielectric constant of the materials (conductor width and dielectric thickness) comprising the line. As the geometry changes from a stripline to microstrip transmission line, the thickness of the layers is adjusted for the desired impedance. Stiffer dielectric materials may also be added to both the first and second layers of dielectric material 32, 38 to control the flexibility of the antenna 20 or to tailor the dielectric constant of the antenna. Films of polyetherimide (PEI) may be used where high strength and good flexibility are required. As is known to those skilled in the art, PEI closely matches the dielectric constant of silicone elastomer and bonds well to both silicone and various outer coating materials. Bonding of the first and second dielectric layers 32, 38 may require the use of heat activated bonding films. Preferably, fluorinated ethylene propylene (FEP) bonding film is utilized with TFE dielectric materials and silicone film is utilized with PEI dielectric materials.

The antenna 20 may undergo curing operations to cure the silicone or other elastomeric material used in the core 34 and to laminate the various layers of material together surrounding the core. Curing operations are typically performed according to the recommendations of the manufacturer of the bonding system used. For example: FEP films may bond at temperatures greater than or equal to 235° C.; silicone elastomer heat cured adhesives may bond at temperatures greater than or equal to 120° C.; or pressure cured silicone elastomer adhesives may be given an accelerated bond at temperatures greater than or equal to 90° C. As is normal in adhesive bonding of thin sheets of materials, pressure may be applied through rigid backing plates. The interface between the backing plate and the material to be bonded may be filled with a compliant elastomer pad. The compliance of the elastomer pad aids in producing a void-free adhesive interface. Features or surface texture on the elastomer pad may be used to create fold lines or bend relief points to aid final assembly of the antenna.

The second layer of dielectric material 38 may contain surface texturing to evenly distribute bending stresses throughout the cross section of the antenna 20. Texturing may be formed via pressure pads used in the curing process. Pressure may be applied during curing to ensure that the silicone fills the voids between the fibers in the conductive material 36.

Figure 6:
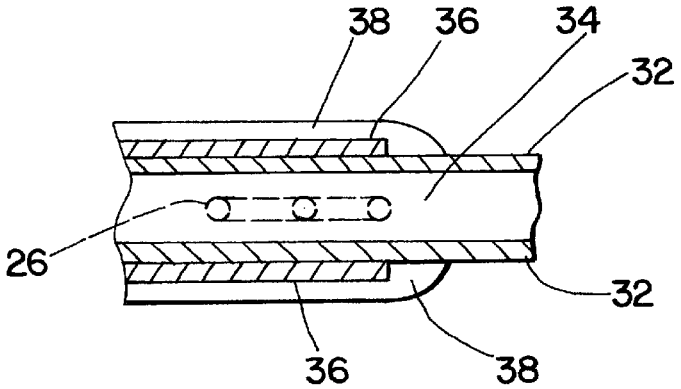
FIG. 6 is a sectional view of the PIFA illustrated in FIG. 2 taken along lines 6—6.

Referring now to FIG. 6, a cross-sectional view of the transition region between the radiating portion 24 and the tuning portion 22 of the antenna 20 of FIG. 2 taken along lines 6—6 is illustrated. In the illustrated embodiment, the second dielectric layer 38 terminates just beyond the termination point of the conductive material 36. However, the second dielectric layer 38 may extend further over the first layer of dielectric material 32. Extending the second dielectric layer 38 over the first layer of dielectric material 32 may be used to produce a more even thickness transition (to aid the bonding process), or to produce a greater stiffness at the transition (to aid bending of the final assembly). A similar configuration may exist in the transition region between the signal feed 28 and the radiating element 24.

A stiffer outer layer of material (not shown) may be utilized to form an environmentally suitable outer surface for the antenna 20. Various materials may be utilized as an outer surface including, but not limited to, FEP. An outer layer of material may be desirable to protect against abrasion and other causes of wear.

Figure 8:
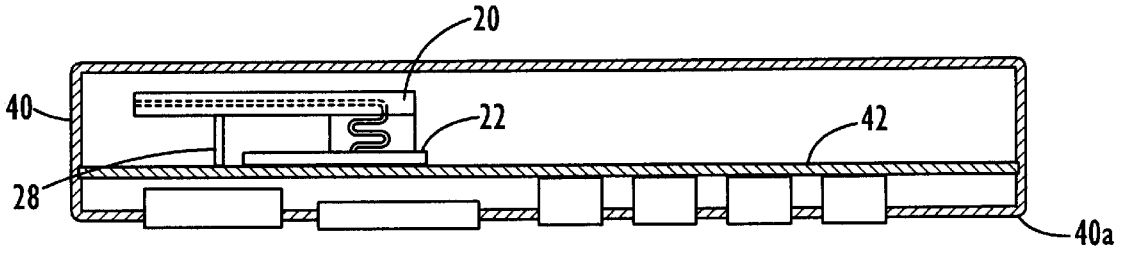
FIG. 8 illustrates an antenna according to the present invention disposed within a radiotelephone housing.

FIG. 8 illustrates an antenna 20 according to the present invention disposed within a radiotelephone. In the illustrated embodiment, the tuning portion 22 of the antenna 20 and the signal feed 28 are electrically connected to the circuit board 42, as would be understood by those of skill in the art. The circuit board 42 and antenna 20 are enclosed within the radiotelephone housing 40. In the illustrated embodiment, a speaker 44, a display panel 46, and a keypad 48 extend from a front portion 40*a* of the housing 40.

Operations for fabricating a flexible diversity antenna according to the present invention are illustrated schematically in FIGS. 7A and 7B. A planar antenna is formed (Block 100) and then folded for assembly within an electronic device (Block 200). Operations for forming a planar antenna include embedding an electrical conductor within an elastomeric core (Block 102), preferably in a meandering configuration. The elastomeric core is then surrounded by a first layer of dielectric material (Block 104). One or more portions of the first layer of dielectric material is surrounded with conductive material to tune the antenna to a predetermined impedance (Block 106). A shielded signal feed is integrally formed with the antenna and extends outwardly therefrom (Block 108). The elastomeric core and materials for bonding the dielectric and conductive layers to the core are cured using curing techniques known to those skilled in the art, including, but not limited to, air curing, thermal curing, infrared curing, microwave curing, and the like (Block 110). Surface texturing may be created in the second layer of dielectric material during curing operations (Block 112).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An antenna, comprising:

a flexible core surrounded by a first layer of flexible dielectric material and having opposite end portions;

a first layer of flexible conductive material surrounding said first layer of flexible dielectric material at one of said end portions;

an electrical conductor embedded within said flexible core and extending between said end portions; and an integral, flexible signal feed extending outwardly from said flexible core, said signal feed electrically connected to said electrical conductor embedded within said flexible core.

2. An antenna according to claim 1 wherein said first layer of flexible conductive material is surrounded by a second layer of flexible dielectric material.

3. An antenna according to claim 2 wherein said first and second layers of flexible dielectric material have a dielectric constant of between about 1.8 and 2.2.

4. An antenna according to claim 2 wherein said first and second layers of flexible dielectric material comprise polyetherimide film.

5. An antenna according to claim 1 wherein said electrical conductor has a meandering configuration through said flexible core.

6. An antenna according to claim 1 wherein said flexible core comprises silicone.

7. An antenna according to claim 1 wherein said first layer of flexible conductive material comprises metalized fabric.

8. An antenna according to claim 7 wherein said metalized fabric is laminated to said first layer of flexible dielectric material with a silicone elastomer.

9. An antenna according to claim 1 wherein said flexible core is formed from material having a dielectric constant of between about 1.8 and 2.2.

10. An antenna according to claim 1 further comprising:

a layer of flexible material surrounding said signal feed;

a third layer of flexible dielectric material surrounding said layer of flexible material that surrounds said signal feed;

a second layer of flexible conductive material surrounding said third layer of flexible dielectric material; and a fourth layer of flexible dielectric material surrounding said second layer of flexible conductive material.

11. A flexible diversity antenna, comprising:

an elastomeric core surrounded by a first layer of dielectric material and having opposite end portions, said first layer of dielectric material having selected portions metalized with conductive material;

an electrical conductor embedded within said elastomeric core and extending between said opposite end portions; and a signal feed extending outwardly from said flexible core, said signal feed electrically connected to said electrical conductor embedded within said elastomeric core.

12. A flexible diversity antenna according to claim 11 further comprising a second layer of dielectric material surrounding said metalized portions of said first layer of dielectric material.

13. A flexible diversity antenna according to claim 11 wherein said electrical conductor has a meandering configuration through said elastomeric core.

14. A flexible diversity antenna according to claim 11 wherein said elastomeric core is formed of silicone.

15. A flexible diversity antenna according to claim 11 further comprising:

a layer of elastomeric material surrounding said signal feed;

a third layer of dielectric material surrounding said layer of elastomeric material that surrounds said signal feed;

conductive material surrounding said third layer of dielectric material; and a fourth layer of dielectric material surrounding said conductive material that surrounds said third layer of dielectric material.

16. A radiotelephone comprising:

a radiotelephone housing;

a circuit board disposed in said housing;

a flexible diversity antenna disposed in said housing, said flexible diversity antenna comprising:

an elastomeric core surrounded by a first layer of dielectric material and having opposite end portions;

a layer of conductive material surrounding one of said end portions; and an electrical conductor embedded within said elastomeric core and extending between said end portions; and a signal feed extending outwardly from said diversity antenna and electrically connecting said electrical conductor embedded within said elastomeric core with said circuit board.

17. A radiotelephone according to claim 16 wherein said layer of conductive material is surrounded by a second layer of dielectric material.

18. A radiotelephone according to claim 17, further comprising:

a layer of elastomeric material surrounding said signal feed;

a third layer of dielectric material surrounding said layer of elastomeric material that surrounds said signal feed;

conductive material surrounding said third layer of dielectric material; and a fourth layer of dielectric material surrounding said conductive material that surrounds said third layer of dielectric material.

19. A radiotelephone according to claim 16 wherein said electrical conductor has a meandering configuration through said elastomeric core.

20. A radiotelephone according to claim 16 wherein said elastomeric core comprises silicone.

21. A radiotelephone according to claim 16 wherein said layer of conductive material comprises metalized fabric.

22. A radiotelephone according to claim 21 wherein said metalized fabric is laminated to said first layer of dielectric material with a silicone elastomer.

23. A method of fabricating a flexible diversity antenna having a predetermined impedance, the method comprising the steps of:

forming a planar antenna having an electrical conductor embedded within an elastomeric core, a first layer of dielectric material surrounding the elastomeric core, portions of the first layer of dielectric material surrounded with conductive material, and a second layer of dielectric material surrounding the conductive material; and folding the planar antenna into a shape for assembly within an electronic device.

24. A method according to claim 23 wherein said step of forming a planar antenna comprises embedding the electrical conductor in a meandering configuration through the elastomeric core.

25. A method according to claim 23 wherein said step of forming a planar antenna comprises forming an integral shielded signal feed extending outwardly from the elastomeric core, wherein the signal feed is electrically connected to the electrical conductor embedded within the elastomeric core.

26. A method according to claim 23 further comprising the step of curing the elastomeric core prior to said step of folding the planar antenna into a shape for assembly within an electronic device.

27. A method according to claim 26 wherein said step of curing the elastomeric core comprises forming surface texturing in the second layer of dielectric material.

28. A method according to claim 23 wherein said step of forming a planar antenna comprises forming the elastomeric core from silicone elastomer.

29. A method according to claim 23 wherein the conductive material is metalized fabric.

30. A method according to claim 23 wherein the metalized fabric is laminated to the first layer of dielectric material with a silicone elastomer.

31. An antenna, comprising:

a flexible core surrounded by a first layer of flexible dielectric material and having opposite end portions;

a first layer of flexible conductive material surrounding said first layer of flexible dielectric material at one of said end portions, wherein said first layer of flexible conductive material comprises metalized fabric, and wherein said metalized fabric is laminated to said first layer of flexible dielectric material with a silicone elastomer; and an electrical conductor embedded within said flexible core and extending between said end portions.

32. An antenna according to claim 31 wherein said first layer of flexible conductive material is surrounded by a second layer of flexible dielectric material.

33. An antenna according to claim 32 wherein said first and second layers of flexible dielectric material have a dielectric constant of between about 1.8 and 2.2.

34. An antenna according to claim 32 wherein said first and second layers of flexible dielectric material comprise polyetherimide film.

35. An antenna according to claim 31 wherein said electrical conductor has a meandering configuration through said flexible core.

36. An antenna according to claim 31 wherein said flexible core comprises silicone.

37. An antenna according to claim 31 wherein said flexible core is formed from material having a dielectric constant of between about 1.8 and 2.2.

* * * * *

UNITED STATES PATENT AND TRADEMARK OFFICE

CERTIFICATE OF CORRECTION

PATENT NO. : 6,005,524
DATED : December 21, 1999
INVENTOR(S) : Gerard James Hayes et al.

It is certified that error appears in the above-identified patent and that said Letters Patent is hereby corrected as shown below:

Title Page:

Section [75]. The third-inventor should be listed as John Michael Spall, Cary.

Section [56]. The following patents should be listed under "U.S. Patent Documents":

| | | |
|---|---|---|
| 4,376,941 | 03/1983 | Zenel |
| 5,870,065 | 02/1999 | Kanba et al. |

Signed and Sealed this

Twenty-first Day of August, 2001

*Attest:*

Nicholas P. Godici

NICHOLAS P. GODICI
*Acting Director of the United States Patent and Trademark Office*

*Attesting Officer*